US005396670A

United States Patent [19]

Firebaugh et al.

[11] Patent Number: 5,396,670

[45] Date of Patent: Mar. 14, 1995

[54] SLING FOR A PATIENT LIFTER

[75] Inventors: Ronald L. Firebaugh, Oshkosh, Wis.; Jim R. Schultz, Thousand Oaks, Calif.

[73] Assignee: Guardian Products, Inc., Simi Valley, Calif.

[21] Appl. No.: 134,283

[22] Filed: Oct. 8, 1993

[51] Int. Cl.[6] ..... A61G 7/10; A61G 7/14

[52] U.S. Cl. ..... 5/89.1; 294/74; 294/140

[58] Field of Search ..... 5/81.1–89.1, 5/625; 294/140, 152, 74

[56] References Cited

U.S. PATENT DOCUMENTS

| | | | |
|---|---|---|---|
| 292,048 | 1/1884 | Reed | 5/87.1 |
| 1,961,119 | 5/1934 | Ettinger | 5/89.1 |
| 2,688,410 | 9/1954 | Nelson | 5/89.1 |
| 2,739,783 | 3/1956 | Pentecost . | |
| 2,792,052 | 5/1957 | Johannesen | 5/83.1 |
| 2,835,902 | 5/1958 | Fash | 5/625 |
| 3,222,029 | 12/1965 | Hildemann | 5/86.1 |
| 3,310,816 | 3/1967 | James et al. . | |
| 3,659,594 | 5/1972 | Schwab | 5/87.1 |
| 3,962,737 | 6/1976 | James | 5/83.1 |
| 3,998,284 | 12/1976 | James | 5/86.1 |
| 4,070,721 | 1/1978 | Stasko | 5/89.1 |
| 4,232,412 | 11/1980 | Petrini | 5/83.1 |
| 4,633,538 | 1/1987 | James | 5/83.1 |
| 4,712,257 | 12/1987 | James | 5/83.1 |
| 5,022,106 | 6/1991 | Richards | 5/86.1 |

FOREIGN PATENT DOCUMENTS

| | | | |
|---|---|---|---|
| 1288379 | 9/1991 | Canada . | |
| 2461492 | 6/1981 | France | 5/86.1 |
| 2140773A | 12/1984 | United Kingdom . | |
| 2154201B | 4/1986 | United Kingdom . | |
| 2164918A | 4/1986 | United Kingdom . | |
| 2182633A | 5/1987 | United Kingdom . | |
| 2184706A | 7/1987 | United Kingdom . | |
| 2223477A | 11/1990 | United Kingdom . | |

OTHER PUBLICATIONS

Molift ® partner brochure (undated).
Molift ® easy brochure (undated).

*Primary Examiner*—Alexander Grosz
*Attorney, Agent, or Firm*—Willian Brinks Hofer Gilson & Lione

[57] ABSTRACT

A sting for a patient lifter has a generally U-shape with two leg straps and at least two side straps to permit the positioning of the patient in a comfortable position. The side straps are located on opposite sides of the sling and include at least two loops.

20 Claims, 2 Drawing Sheets

SLING FOR A PATIENT LIFTER

BACKGROUND OF THE INVENTION

The present invention relates to an improved and safer sling for a patient lifter. In particular, the sling of the present invention allows a patient to be lifted from any of several support heights while allowing the patient in the sling to attain a proper and safe position.

Slings in the prior art have the disadvantage of positioning the patient in only a single position. In addition, when prior art slings are used with known patient lifters they have the disadvantage that when they are used to lift a patient from a bed or other support having a substantial height, the patient lifter is not capable of lifting the patient due to the travel height of the patient lifter and the length of the straps on the sling. As a result, assistants using some prior art slings with known patient lifters have been known to wrap or tie the lifting straps in knots to shorten the length of the straps so that the patient can be lifted. Wrapping or knotting the straps, however, causes them to wear out and limits the movement of the straps and thus the sling on the patient lifter.

The present invention solves these problems by providing a plurality of lifting straps so that the sling can be safely used to lift a patient from a variety of height support surfaces.

SUMMARY OF THE INVENTION

One embodiment of the present invention comprises a sling for a patient lifter that has a U-shaped body with a two leg straps, at least two side straps on one side of the body, and at least two side straps on the other side of the body. The first leg strap is located at one distal end of the body and the second leg strap is located at the other distal end of the body. Each of the side straps on one side of the body has a first and a second end attached to the body to define loops. The first ends of each of the side straps are aligned and the second ends of each of the side straps are also aligned. Each of the loops on the one side of the body has a perimeter length different from the perimeter length of each of the other loops. Each of the side straps on the other side of the body has a first and a second end attached to the body to define loops. The first ends of each of the side straps are aligned and the second ends of each of the side straps are also aligned. Each of the loops on the other side of the body has a perimeter length different from the perimeter length of each of the other loops.

In a preferred embodiment, the sling includes a body having a back support portion and a pair of spaced apart thigh support sections extending from the back support portion. A leg strap is attached to the distal end of one thigh support section with another leg strap attached to the distal end of the other thigh support section. The sling is further provided with a plurality of left side straps located on the left side of the body with a plurality of right side straps located on the right side of the body. Each left side strap has a first and a second end with each of the first ends being aligned and each of the second ends being aligned. Each left side strap defines a loop that has a perimeter length different from the perimeter length of each of the other left side loops. Each right side strap has a first and a second end with each of the first ends being aligned and each of the second ends being aligned. Each right side strap defines a loop that has a perimeter length different from the perimeter length of each of the other right side loops.

More preferably, a continuous webbing is attached to substantially the entire periphery of the sling. Starting from the bottom of the back support portion of the sling, the webbing travels along the inner flank of the right thigh support section, extends beyond the distal end of the right thigh support section and to the outer flank of the right thigh support section to define a right side leg strap. The webbing continues from the outer flank of the right thigh support section to and beyond the periphery of the right shoulder to the top of the back support portion of the sling to define a first right side strap. The webbing continues across the top beyond the periphery of the top to the left shoulder to define a first left side strap. The webbing continues from the left shoulder to the outer flank of the left thigh support section, beyond the distal end of the left thigh support section and to the inner flank of the left thigh support section to define a left side leg strap. The webbing then travels along the inner flank of the left thigh support section to the bottom of the back support section of the sling. In this more preferred embodiment, a second left side strap and a second right side strap are attached, respectively to the top and the left shoulder and the top and the right shoulder. Each of the second left and right side straps have a smaller perimeter length than the first left and right side straps, respectively.

As used in the description and accompanying claims the orientations left and right are used and refer to the viewer's orientation of left and right when viewing the sling illustrated in FIG. 2. The sling of the present invention is, however, symmetrical about a center line and therefore the orientations of left and right are mirror images.

DETAILED DESCRIPTION OF THE DRAWINGS

DETAILED DESCRIPTION OF THE PREFERRED EMBODIMENTS

Figure 1:
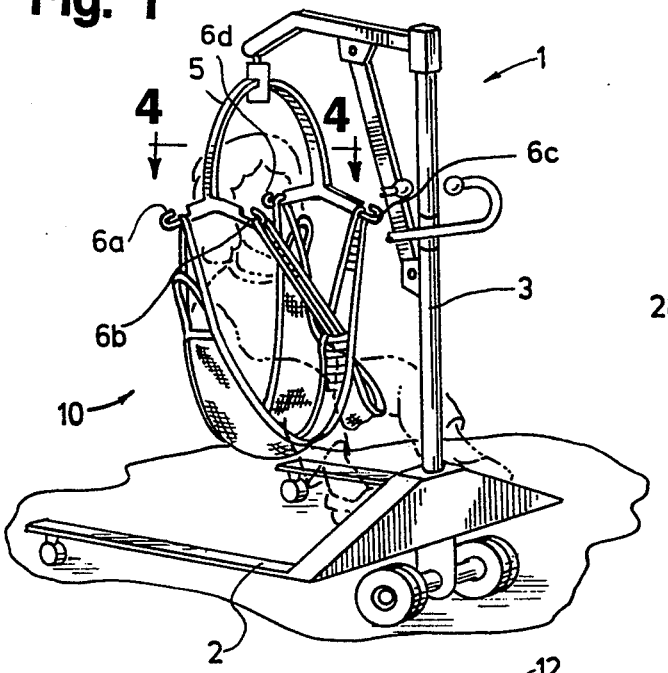
FIG. 1 is a perspective view of one embodiment of the sling of the present invention attached to patient lifter.
Figure 3:
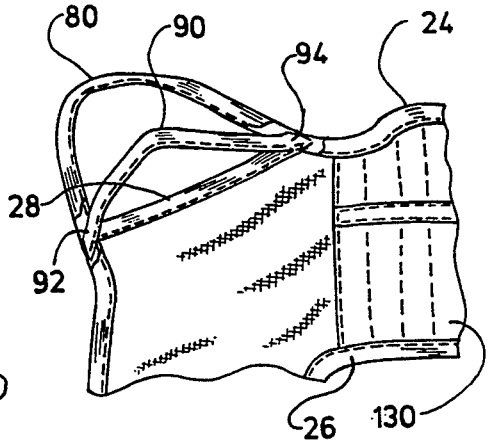
FIG. 3 is an enlarged view of a potion of the sling of FIG. 2 illustrating the left side straps.

Referring now to the drawings where FIG. 1 illustrates the use of the sling of the present invention with a known patient lifter. The illustrated patient lifter 1 has a base 2 with a mast 3 that carries a vertically moveable boom 4 which in turn carries a four point cradle 5. The cradle has four hooks *6a, 6b, 6c,* and *6d* that receive and carry the straps of the sling. It will be appreciated that the hooks *6a* and *6b* lie on one side (i.e., the left side) of the cradle and that the hooks *6c* and *6d* lie on the other side (i.e., the right side) of the cradle. The sling of the present invention is particularly useful with a patient lifter having a four point cradle.

Figure 2:
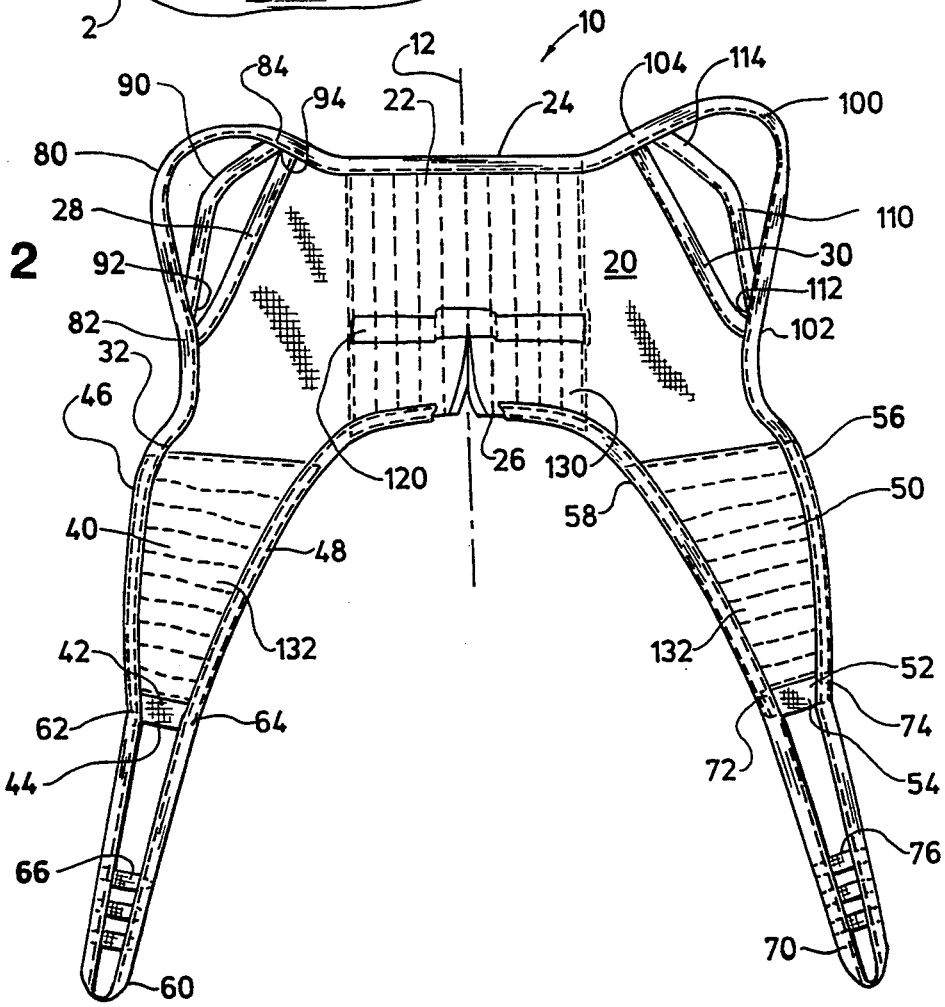
FIG. 2 is a plan view of the back of one embodiment of the sling of the present invention.
Figure 4:
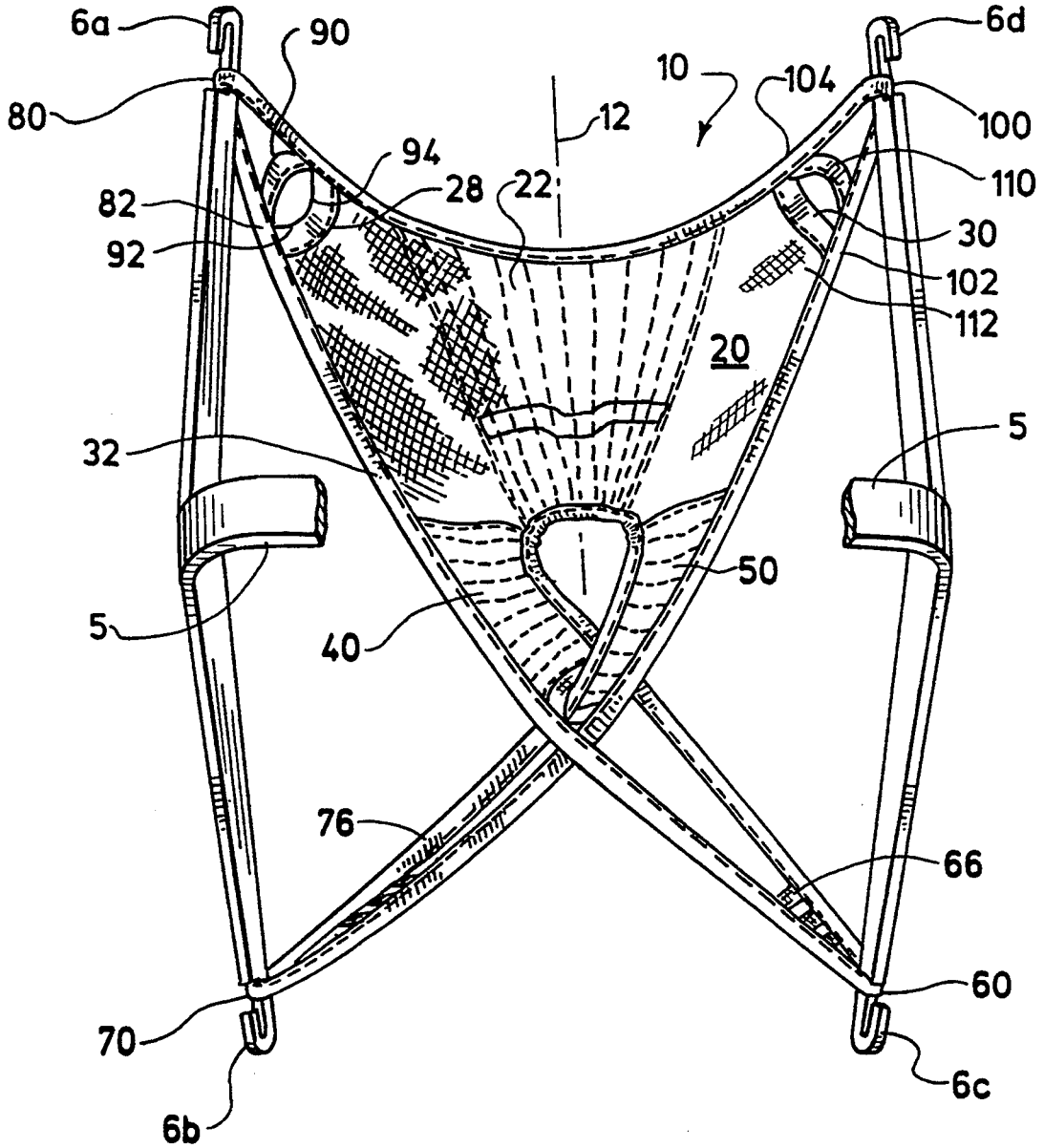
FIG. 4 is a top view of the sling of the present invention attached to the cradle of a patient lifter.

One embodiment of the sling of the present invention is illustrated in FIG. 2. The sling 10 includes a body 20 formed in a generally U-shape with a first or left leg strap 60, a second or right leg strap 70, a first 80 and a second 90 left side strap, and a first 100 and a second 110 right side strap with each of the straps capable of being supported on the cradle of the patient lifter. The sling 10 is symmetrical about a vertical center line 12 which divides the sling into a left side and a right side. Generally, the sling 10 of the present invention comprises a unitary piece of fabric, preferably nylon or polyester, which will safely support a patient within the sling. The straps are preferably made of nylon webbing but can be made from any suitable material capable of supporting the weight of an individual carried within the sling.

More particularly, the body includes a back portion 22 with a first or left thigh support 40 and a second or right thigh support 50 spaced apart and extending from the body to define a U-shape. The back portion has a top 24, a bottom 26, a first or left shoulder 28, and a second or right shoulder 30.

The body may further include a holding strap 120 disposed between the top and the bottom and parallel to the top. The holding strap will be oriented on the outside of the sling with the patient considered to be located on the inside of the sling. The strap 120 will allow the assistant lifting the patient to easily rotate and direct the sling when the patient is seated within the sling. The body may also include a semi-rigid material 130 attached to or provided within the confines of the body to add further support to the individual positioned within the sling. The semi-rigid material may be foam padding or other suitable material formed in panels that extend vertically from the top 24 to the bottom 26 across a substantial portion of the body from the left shoulder to the right shoulder.

The left thigh support 40 is coextensive with and extends from the body to define a distal end 42 having a width 44. The left thigh support is defined by an outer flank 46 and an inner flank 48. The right thigh support 50 is also coextensive with and extends from the body to define a distal end 52 having a width 54. The right thigh support is defined by an outer flank 56 and an inner flank 58. The inner flanks 48 and 58 are joined at the bottom 26. The right thigh support is spaced from the left thigh support to define a U-shaped sling. The lower outer width of the sling, defined by the distance from the outer flank 46 to the outer flank 56, is greater than the upper width of the sling, defined by the distance from the left shoulder 28 to the right shoulder 30.

A first or left side leg strap 60 is attached to the distal end 42 of the left thigh support 40. The left leg strap has a first anchorage end 62 and a second anchorage end 64 with each anchorage end attached to the distal end of the left thigh support to define a loop. The first end of the left leg strap is coextensive with the outer flank 46 of the left thigh support. The second end of the left leg strap is coextensive with the inner flank 48 of the left thigh support. Preferably, as will be further described below, the strap 60 is formed from a continuous webbing that extends substantially the entire perimeter of the sling. In this case, the ends 62 and 64 described above are defined as the portions of the strap that are attached to the perimeter of the sling at the distal end of the left thigh support section. The left leg strap may further have a plurality of lateral dividers 66 that section the loop and define openings so that the distance from the distal end of left thigh support to the cradle can be varied.

A second or right side leg strap 70 is attached to the distal end 52 of the right thigh support 50. The right leg strap has a first anchorage end 72 and a second anchorage end 74 with each end attached to the distal end of the right thigh support to define a loop. The first end of the left leg strap is coextensive with the outer flank 56 of the right thigh support. The second end of the right leg strap is coextensive with the inner flank 58 of the right thigh support. Preferably, as will be further described below, the strap 70 is formed from a continuous webbing that extends substantially the entire perimeter of the sling. In this case, the ends 72 and 74 described above are defined as the portions of the strap that are attached to the perimeter of the sling at the distal end of the left thigh support section. The right leg strap may further have a plurality of lateral dividers 76 that section the loop and define openings so that the distance from the distal end of the right thigh support to the cradle can be varied.

The thigh supports 40 and 50 may further include semi-rigid supports 132 in the form of foam padding panels disposed perpendicularly to the inner and outer flanks. The panels extend substantially horizontally from the inner flank to the outer flank along a substantial length of the thigh support from the proximal end to the distal end of the thigh supports. In this way, when the patient is positioned within the sling, the stress on the patient's femur and skin sheer on the back of the leg is more evenly distributed to minimize any discomfort and constriction of the patient's legs.

As noted above, each side of the body of the sling includes a plurality of side straps. Preferably, each side of the body includes a first and a second side strap located at each side of the shoulder of the body. In particular, a first 80 and a second 90 side strap are attached to the left shoulder 26 and a first 100 and a second 110 side strap are attached to the right shoulder 28. Each strap 80, 90, 100, 110 defines a loop such that the perimeter length of the first side strap 80 and 100 is greater than the perimeter length of the second side strap 90 and 110. In this way, the sling can be easily used to lift a patient from differing heights of support surfaces without having to knot or wind the straps. Although in the preferred embodiment, two side straps for each shoulder are illustrated, it will be understood that any suitable number of two or more side straps for each shoulder can be provided to accommodate a variety of differing support height surfaces.

In the preferred embodiment illustrated in FIG. 2, the first left side strap 80 has a first end 82 and a second end 84 with the first end attached to the left shoulder and the second end spaced from the first end and attached to the left shoulder to define a loop. Preferably, the second end 84 is attached to the sling in the area where the left shoulder and the top of the back support portion meet. More preferably, the second end is coextensive with the top 24. The strap 80 has a perimeter length defined by the length on the left shoulder spanned by the first end 82 and the second end 84 and the length of the strap 80 from the first end 82 to the second end 84. More preferably, as will be further described below, the first strap 80 is formed from a continuous webbing attached to substantially the entire periphery of the sling. The first and second ends 82 and 84 are therefore defined as the portion of the strap 80 at the periphery of the sling.

The second left side strap 90 has a first end 92 and a second end 94 with the first end attached to the left shoulder and the second end spaced from the first end and attached to the left shoulder to define a loop. Preferably, the second end 94 is attached to the sling in the area where the left shoulder 28 and the top 24 of the back support portion meet. More preferably, the second end is coextensive with the top 24. The strap 90 has a perimeter length defined by the length on the left shoulder spanned by the first end 92 and the second end 94 and the length of the strap 90 from the first end 92 to the second end 94. The perimeter length of the second left side strap is different than the perimeter length of the first left side strap. Preferably, the perimeter length of the second left side strap is less than the perimeter length of the first left side strap.

Preferably, the first end 82 of the first strap 80 and the first end 92 of the second strap 90 are aligned with each other and attached to the left shoulder at substantially the same location. The second end 84 of the first strap 80 and the second end 94 of the second strap 90 are also aligned with each other and attached to the left shoulder at substantially the same location, preferably where the left shoulder and the top of the back support portion meet. More preferably, the second end 84 and the second end 94 are coextensive with the top 22. In this case, when measuring the perimeter distance of the first and the second left side straps, the length along the shoulder spanned by the first ends 82 and 92 and the second ends 84 and 94 will be substantially equal. It will therefore be understood that the distance from the first end 82 to the second end 84 on the first strap 80 is greater than the distance from the first end 92 to the second end 94 on the second strap 90.

Likewise, the first fight side strap 100 has a first end 102 and a second end 104 with the first end attached to the right shoulder and the second end spaced from the first end and attached to the fight shoulder to define a loop. Preferably, the second end 104 is attached to the sling in the area where the right shoulder and the top 24 of the back support portion meet. More preferably, the second end is coextensive with the top 24. The strap 100 has a perimeter length defined by the length on the right shoulder spanned by the first end 102 and the second end 104 and the length of the strap 100 from the first end 102 to the second end 104. More preferably, as will be further described below, the first strap 100 is formed from a continuous webbing attached to substantially the entire periphery of the sling. The first and second ends 102 and 104 are therefore defined as the portion of the strap 100 at the periphery of the sling.

The second side strap 110 has a first end 112 and a second end 114 with the first end attached to the right shoulder and the second end spaced from the first end and attached to the right shoulder to define a loop. Preferably, the second end 114 is attached to the sling in the area where the right shoulder 30 and the top 24 of the back support portion meet. More preferably, the second end is coextensive with the top 24. The strap 110 has a perimeter length defined by the length on the right shoulder spanned by the first end 112 and the second end 114 and the length of the strap 110 from the first end 112 to the second end 114. The perimeter length of the second left side strap is different than the perimeter length of the first left side strap. Preferably, the perimeter length of the second left side strap is less than the perimeter length of the first left side strap.

Preferably, the first end 102 of the first strap and the first end 112 of the second strap are aligned with each other and attached to the right shoulder at substantially the same location. The second end 104 of the first strap and the second end 114 of the second strap are also aligned with each other and attached to the right shoulder at substantially the same location, preferably where the right shoulder and the top of the back support portion meet. More preferably, the second end 104 and the second end 114 are coextensive with the top 24. In this case, when measuring the perimeter distance of the first and the second straps, the length along the right shoulder spanned by the first ends 102 and 112 and the second ends 104 and 114 will be substantially equal. It will therefore be understood that the distance from the first end 102 to the second end 104 on the first strap 100 is greater than the distance from the first end 112 to the second end 114 on the second strap 110.

In the most preferred embodiment, a continuous webbing is attached to substantially the entire perimeter of the sling. Starting from the bottom 26 of the back support portion of the sling, the webbing travels along the inner flank 58 of the right thigh support section, extends beyond the distal end 52 of the right thigh support section and to the outer flank 56 of the right thigh support section to define a right side leg strap 70. In this way the ends 74 and 72 of the right side leg strap, as defined above, are coextensive with the inner 58 and outer 56 flanks, respectively. The webbing continues from the outer flank of the right thigh support to and beyond the periphery of the right shoulder 30 to the top 24 of the back support portion of the sling to define a first right side strap 100. The ends 112 and 114 of the strap 110, as defined above, are coextensive with the shoulder 30 and the top 24, respectively.

The webbing continues across the top beyond the periphery of the top 24 to the left shoulder 28 to define a first left side strap 80. The ends 94 and 92 of the strap, as defined above, are coextensive with the top 24 and the left shoulder 28, respectively. The webbing continues from the left shoulder 28 to the outer flank 46 of the left thigh support section, beyond the distal end 42 of the left thigh support section and to the inner flank 48 of the left thigh support section to define a left side leg strap 60. The ends 62 and 64 of the left leg strap, as defined above, are coextensive with the outer 46 and inner 48 flanks, respectively. The webbing then travels along the inner flank 48 of the left thigh support section to the bottom 26 of the back support section of the sling. In this more preferred embodiment, the second left side strap 90 and the second right side strap 110 are attached, respectively, to the top and the left shoulder and the top and the right shoulder. Each of the second left and right side straps have a smaller perimeter length than the first left and first right side straps, respectively.

In operation, the lower portion of the patient's back is placed against the back portion 22 of the sling with the thigh supports positioned under each of the patient's respective thighs. One leg strap is crossed with the other, for example, the left leg strap 60 is crossed with (placed within) the loop defined by the right leg strap 70. Depending upon the height of the support surface, for example the bed, either the first left side strap 80 or the second left side strap 90 will be placed around a hook on the cradle. Likewise, either the first right side strap 100 or the second right side strap 110 will be placed around a hook on the cradle. The leg straps are also placed around their respective hooks on the cradle. Thereafter, the patient can be lifted or lowered as needed.

For example, if the first left side strap 80 is placed on the cradle, then the first right side strap 100 will also be placed on the cradle. In this situation, the first left side strap 80 will be placed around hook *6a* with the right leg strap 70 placed around hook *6b* and the first right side strap 100 will be placed around hook *6c* with the left leg strap 60 placed around hook *6c*. When the straps are so positioned and the patient is lifted, it will be appreciated by one skilled in the art that the area of each strap that contacts the hook can be varied as a result of each patient's center of gravity in order to ensure that the patient is safely positioned within the sling.

The sling of the present invention is designed to be stable, durable, and comfortable. It should be understood, however, that a wide range of changes and modifications can be made to the embodiments described above. It is therefore intended that the foregoing description illustrates rather than limits this invention, and that it is the following claims, including all equivalents, which define this invention.

What is claimed is:

1. A sling for a patient lifter comprising:

a reversed U-shaped body;

b. a first and a second leg strap with each strap located at the distal end of the U;

c. at least two left side straps, with each left side strap having a first and second end both attached to the body to form a loop, each of the first ends of each left side strap being aligned and each of the second ends of each left side strap being aligned wherein each left side strap defines a loop having a perimeter length different than the perimeter length of each of the other loops; and, d. at least two right side straps with each right side strap having a first and second end both attached to the body to form a loop, each of the first ends of each right side strap being aligned and each of the second ends of each right side strap being aligned wherein each right side strap defines a loop having a perimeter length different than the perimeter length of each of the other loops.

2. The sling of claim 1 wherein the U-shaped body includes a back support portion and a pair of spaced apart thigh support sections extending from the back support section.

3. The sling of claim 2 wherein the back support portion includes a top, a left shoulder, a right shoulder, and a bottom.

4. The sling of claim 3 wherein the thigh support sections extend from the bottom of the back support portion and define a distal end.

5. The sling of claim 4 wherein each thigh support section is defined by an outer flank and an inner flank with the inner flanks joined at the bottom of the back support portion.

6. The sling of claim 5 wherein each leg strap extends from the distal end of the thigh support section.

7. The sling of claim 3 wherein the left side straps are attached to the sling at the left shoulder of the back support and the right side straps are attached to the sling at the right shoulder of the back support.

8. The sling of claim 3 wherein the back support further includes a strap located between the top and the bottom.

9. The sling of claim 3 wherein the back support further includes a semi-rigid material located between the top and the bottom.

10. A sling for a patient lifter comprising:

a. a body including a back support portion and a pair of spaced apart thigh support sections extending from the back support section;

b. a first and a second leg strap with each leg strap located at the distal end of the thigh support sections;

c. at least two left side straps, with each left side strap having a first and a second end attached to the back support portion to form a loop, each of the first ends of each left side strap being aligned and each of the second ends of each left side strap being aligned wherein each left side strap defines a loop having a perimeter length different than the perimeter length of each of the other loops; and, d. at least two right side straps with each right side strap having a first and a second end attached to the body to form a loop, each of the first ends of each right side strap being aligned and each of the second ends of each right side strap being aligned wherein each right side strap defines a loop having a perimeter length different than the perimeter length of each of the other loops.

11. The sling of claim 10 wherein the back support portion includes a top, a left shoulder, a right shoulder, and a bottom.

12. The sling of claim 11 wherein the thigh support sections extend from the bottom of the back support portion and define a distal end.

13. The sling of claim 12 wherein the each thigh support section is defined by an outer flank and an inner flank with the inner flanks joined at the bottom of the back support portion.

14. The sling of claim 13 wherein each leg strap extends from the distal end of the thigh support section.

15. The sling of claim 14 wherein the left side straps are attached to the sling at the left shoulder of the back support and the right side straps are attached to the sling at the right shoulder of the back support.

16. The sling of claim 11 wherein the back support further includes a strap located between the top and the bottom.

17. The sling of claim 11 wherein the back support further includes a semi-rigid material located between the top and the bottom.

18. A sling for a patient lifter comprising:

a. a body including a back support portion including a top, a left shoulder, a right shoulder, a bottom and a first and second spaced apart thigh support sections extending from the bottom of the back support portion to define a distal end, each thigh support section defined by an outer flank and an inner flank with the inner flanks joined at the bottom of the back support portion;

b. a first leg strap located at the distal end of the first thigh support section;

c. a second leg strap located at the distal end of the second thigh support section;

d. a first left side strap having a first and a second end attached to the left shoulder of the back support portion to form a first left side loop;

e. a second left side strap having a first and a second end attached to the left shoulder of the back support portion to form a second left side loop, the first end of the first left side strap is aligned with the first end of the second left side and the second end of the first left side strap is aligned with the second end of the second left side strap wherein the first left side loop has a perimeter length greater than the second left side loop;

f. a first right side strap having a first and a second end attached to the right shoulder of the back support portion to form a first right side loop; and, g. a second right side strap having a first and a second attached to the right shoulder of the back support portion to form a second fight side loop, the first end of the first right side strap is aligned with the first end of the second right side strap and the second end of the first right side strap is aligned with the second end of the second right side strap, wherein the first right side loop has a perimeter length greater than the second right side loop.

19. The sling of claim 18 wherein the back support further includes a strap located between the top and the bottom.

20. The sling of claim 18 wherein the back support further includes a semi-rigid material located between the top and the bottom.

* * * * *